US006553926B2

(12) United States Patent
Stucki

(10) Patent No.: US 6,553,926 B2
(45) Date of Patent: Apr. 29, 2003

(54) DEVICE FOR DETACHABLE FASTENING OF AN EMBROIDERY FRAME ON AN EMBROIDERY FRAME SUPPORT

(75) Inventor: André Stucki, Steckborn (CH)

(73) Assignee: Fritz Gegauf Aktiengesellschaft Bernina-Nahmaschinenfabrik, Steckborn (SE)

( * ) Notice: Subject to any disclaimer, the term of this patent is extended or adjusted under 35 U.S.C. 154(b) by 0 days.

(21) Appl. No.: 10/158,292

(22) Filed: May 30, 2002

(65) Prior Publication Data

US 2002/0195034 A1 Dec. 26, 2002

(30) Foreign Application Priority Data

Jun. 25, 2001 (CH) ..... 1153/01

(51) Int. Cl.[7] ..... D05B 21/00; D05C 9/04
(52) U.S. Cl. ..... 112/102.5; 112/103
(58) Field of Search ..... 112/102.5, 470.06, 112/103, 470.01, 475.19; 700/138

(56) References Cited

U.S. PATENT DOCUMENTS 5,865,133 A * 2/1999 Herbach et al. ..... 112/475.19
6,237,516 B1 * 5/2001 Wakayama ..... 112/102.5

FOREIGN PATENT DOCUMENTS

DE 29612102 U1 1/1996
DE 29614512 11/1996

* cited by examiner

*Primary Examiner*—Peter Nerbun
(74) *Attorney, Agent, or Firm*—Volpe and Koening, P.C.

(57) ABSTRACT

A device for detachable fastening of an embroidery frame (27) with one or more embroidering fields on an embroidery frame support (25) of a program-controlled sewing or embroidering machine. On the embroidery frame (27), two sliding interlocks (61) are fastened which guarantee a play-free latching in the x and y direction and which, for sliding the embroidery frame (27) in relation to the embroidery frame support (25), move a latching element temporarily out of a latching slot (51). The latching element is configured as a pivotable lever with a downward-projecting detent.

9 Claims, 4 Drawing Sheets

DEVICE FOR DETACHABLE FASTENING OF AN EMBROIDERY FRAME ON AN EMBROIDERY FRAME SUPPORT

BACKGROUND

The invention relates to a device for detachable fastening of an embroidery frame on an embroidery frame support, and more particularly to such devices for an embroidery module in a program-controlled sewing or embroidering machine.

The connection between an embroidery frame and its support which has the drive apparatus for the embroidery frame, must be separable in order on the one hand to have the possibility of being able to fasten embroidery frames of various size and shape on the embroidery frame support, and on the other hand, to be able to lay the material to be embroidered, for example a fabric, outside the sewing machine into the embroidery frame, and to fasten it there.

From DE-GM 29 614 512, such a device for detachable fastening of an embroidery frame on the embroidery frame support of a program-controlled sewing or embroidering machine is known. In the embroidery frame support which is arranged in household sewing machines alongside the lower arm and is connected with this through coupling and latching devices, the drive means for movement of the embroidery frame attachments in the x and y direction is arranged. On the embroidery frame support, a holding angle of steel with upward-projecting retaining studs is provided for connecting or coupling the embroidery frame. On the embroidery frame, a guidance channel open downward is fastened, into which the vertical section of the holding angle is latchable with the retaining studs insertable from below, and latchable through two opposing movable locking slides. The sliding interlocks are guided lengthwise in the guidance channel and connected with two holding plates. The holding plates project beyond the guidance channel such that they can be grasped with two fingers of a hand and can be pressed against each other. Between the two locking slides, a spring is inserted which presses these apart when the spring is released, and thus pushes the outwardly directed ends under the retaining studs in the guidance channel. This known device makes it possible, in a simple manner and with the use of only one hand, to fasten the embroidery frame on the embroidery frame support or to remove it therefrom. It has, however, the disadvantage that the embroidery frame, due to the vertically operating latching in the x and y direction, cannot be held sufficiently free of play and in this way, the reproducibility of the embroidered pattern cannot be guaranteed in every case.

From DE-GM 29612102, a device for the automatic identification of the size and construction of an embroidery frame on a sewing or an embroidering machine with program-controlled embroidering device is furthermore known. This device makes it possible for the control unit of the sewing machine to recognize the embroidery frame directly connected with the embroidery frame support and therewith to utilize completely the surface available for embroidering within the embroidery frame. As a means of identification, on the embroidery frame, in the region below the guidance channel, corresponding means of identification, for example, coding prongs, are provided. The identification means are joined fast with the coupling and latching apparatus in the known device, and for this reason only allow a recognition of the respective embroidery frame which is connected fast with the latching apparatus. If there is a possibility on the embroidery frame of connecting this at various points with the embroidery frame support, then in the known manner, no identification of the fastening point can take place on the corresponding embroidery frame.

SUMMARY

The object of the present invention is to create a device for detachable fastening of an embroidery frame which not only makes it possible to join the embroidery frame with the embroidery frame support, but to lock the embroidery frame in at different places with reference to the embroidery frame support in order to be able, by successively using correspondingly larger embroidery frames, to embroider basically larger embroidering fields.

A further object is to provide, after fastening the embroidery frame on the embroidery frame support, the possibility of making the place of attachment on the respective embroidery frame type determinable by the control unit or appropriate sensors.

This object is accomplished by a device in accordance with the invention by providing a drive connected to an embroidery frame support with an embroidery frame holding plate attached thereupon. A retaining and latching element is installed on the embroidery frame with two movable sliding interlocks with spring-loaded grips. The sliding interlocks each engage with one latching hook on correspondingly constructed latching surfaces in recesses located in plates on the embroidery frame holding plate. The retaining element is mounted movable along a guide rail on the embroidery frame, and code sections and latching slots are positioned on the guide rail or on the embroidery frame.

With the device of the invention, a play-free latching of the embroidery frame on the embroidery frame support is possible, and at the same time, with one and the same latching and coupling device, the embroidery frame can not only be joined with the embroidery frame support, but also to move this without the prior detachment from the embroidery frame support, latching it again, and identifying the latching site through the control unit. By pressing together both holding buttons, the embroidery frame can consequently be lifted from the embroidery frame support again as previously, or it can be slid along a guide track fastened to the embroidery frame and fixed at a suitable position, and the fastening site on the embroidery frame can be recognized by the guide unit of the machine. Sliding the embroidery frame in relation to the embroidery frame support takes place through briefly pressing the holding buttons together and subsequent lateral sliding of the embroidery frame. The locking in into the adjacent operating position then takes place automatically. When locking in, additionally a play-free clamping of the embroidery frame with the embroidery frame support takes place without further interventions by the operator being necessary.

BRIEF DESCRIPTION OF THE DRAWINGS

The invention will be explained in greater detail on the basis of a preferred embodiment. In the drawings.

DETAILED DESCRIPTION OF THE PREFERRED EMBODIMENT

Figure 1:
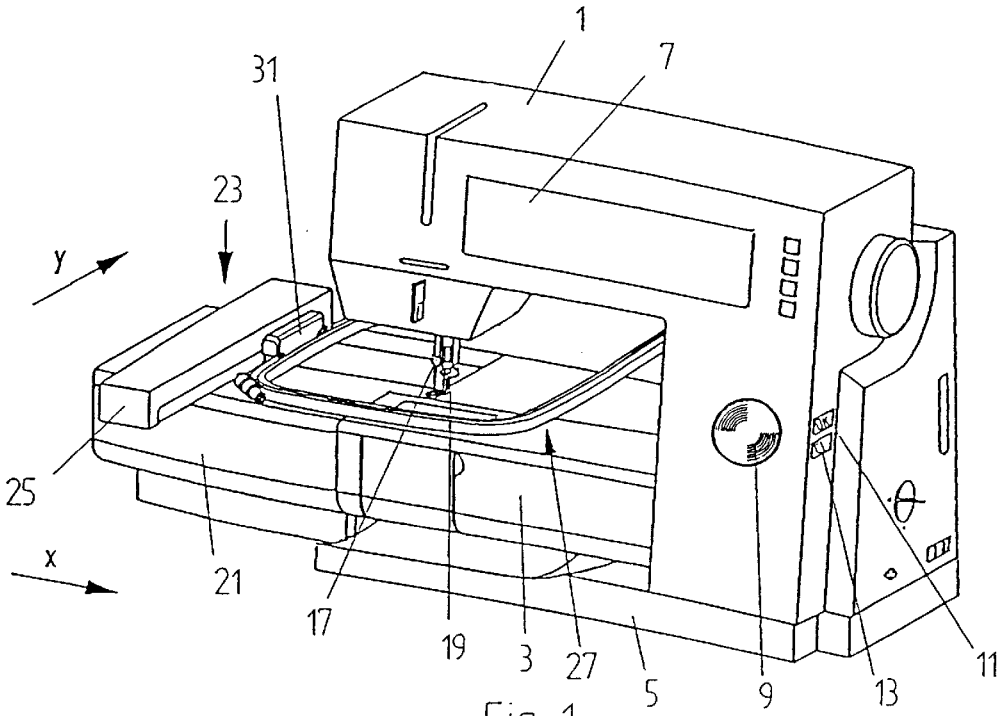
FIG. 1 is a perspective view of a household sewing machine with an attached embroidering module and installed embroidery frame in accordance with the present invention.
Figure 2:
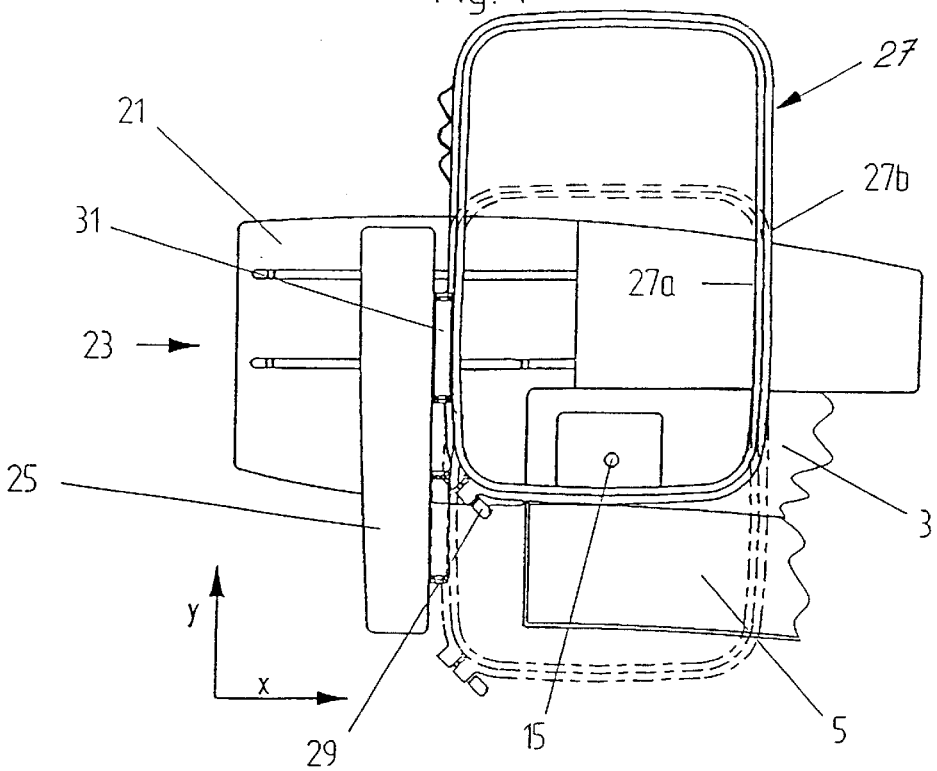
FIG. 2 is a plan view on the embroidering module and the embroidery frame as well as on the front end of the lower arm of the sewing machine with the embroidery plate.

The sewing machine in accordance with FIGS. 1 and 2 has the usual sewing components, operating elements and other outfitting parts (in part not indicated in greater detail). It basically includes the machine housing 1, the free arm 3 and the base plate 5. On the machine housing 1, for example, a video screen 7, a track ball 9 with dedicated activation key (OK) 11 and release key (CL) 13 and a row of keys (not indicated in greater detail) for the direct selection of special functions. The needle 17 is shown that acts through the tapping hole 15 with a not illustrated holding device, and the presser foot that operates on the (not illustrated) sewing material is designated with 19. The basic unit 21 of a mechanical and electrical connecting device (not illustrated) with the embroidering module 23 joinable with the sewing machine 1 contains the program-controlled drive apparatus for the embroidery frame support 25 for moving the support 25 in the x direction. In the embroidery frame support 25, further drive equipment is provided for moving the embroidery frame 27 in the y direction. The embroidery frame 27 is, as generally typical, constructed in two parts and includes a closed interior frame 27*a* and a divided outer frame 27*b*. On the outer frame 27*b*, a clamping device 29 for clamping the sewing material is arranged. The embroidery frame 27 is connectable with the embroidery frame support 25 by means of a fastening device generally designated with 31.

Figure 3:
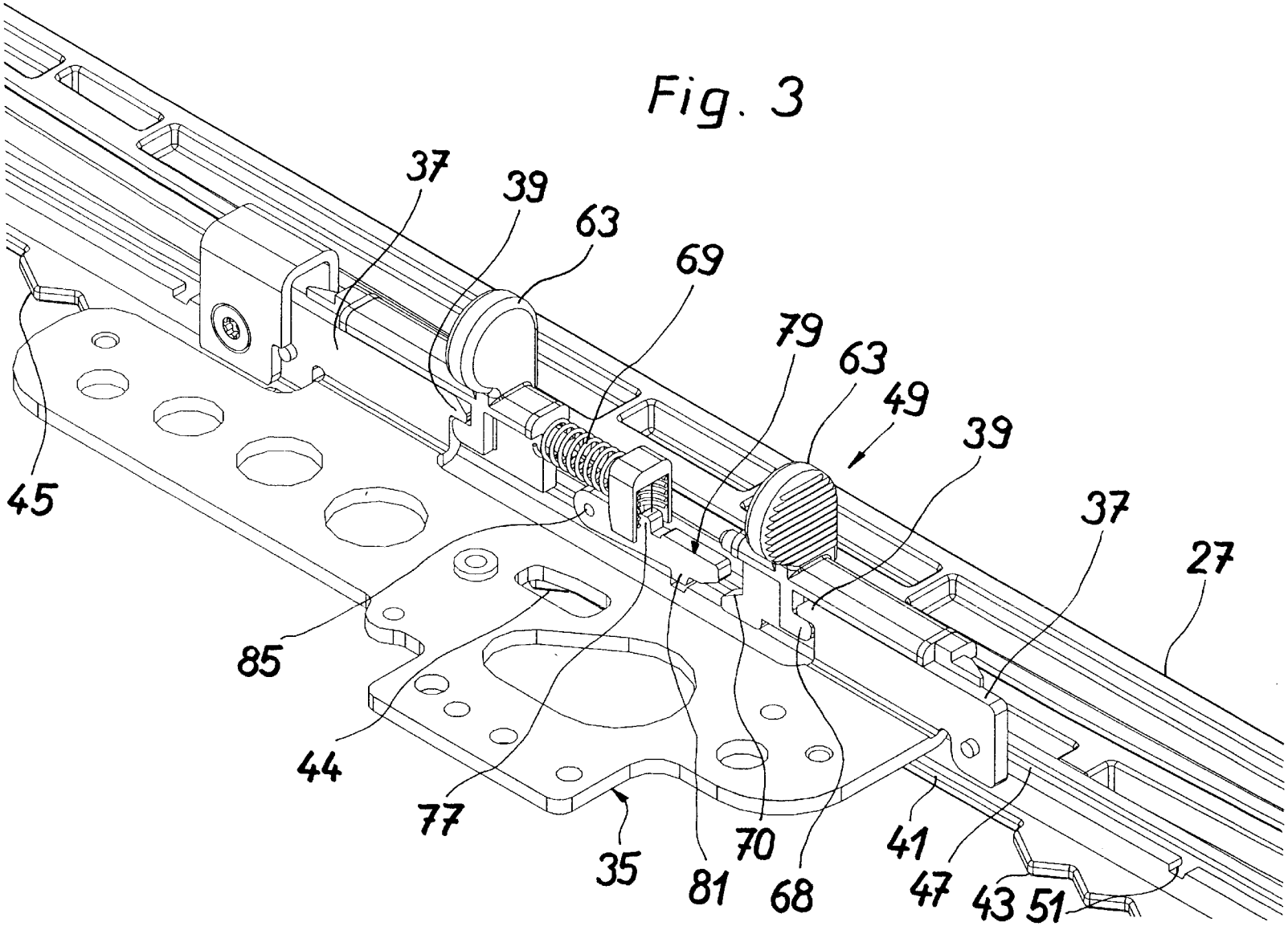
FIG. 3 is a perspective view of the latching and coupling apparatus without casing when releasing the latching on position "44,"
Figure 4:
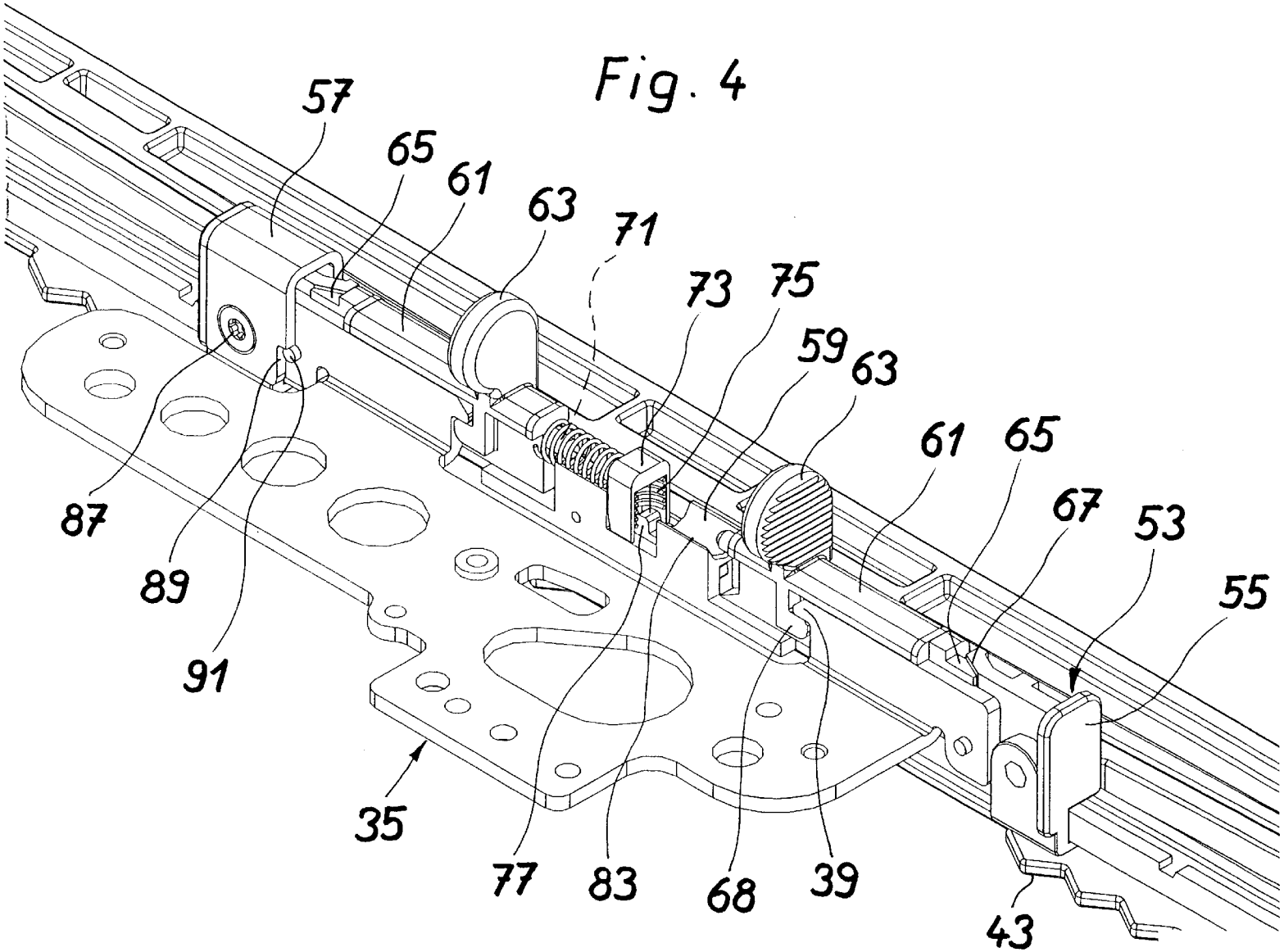
FIG. 4 is a perspective view of the latching and coupling apparatus without casing with a locked in jack on position "44,"
Figure 5:
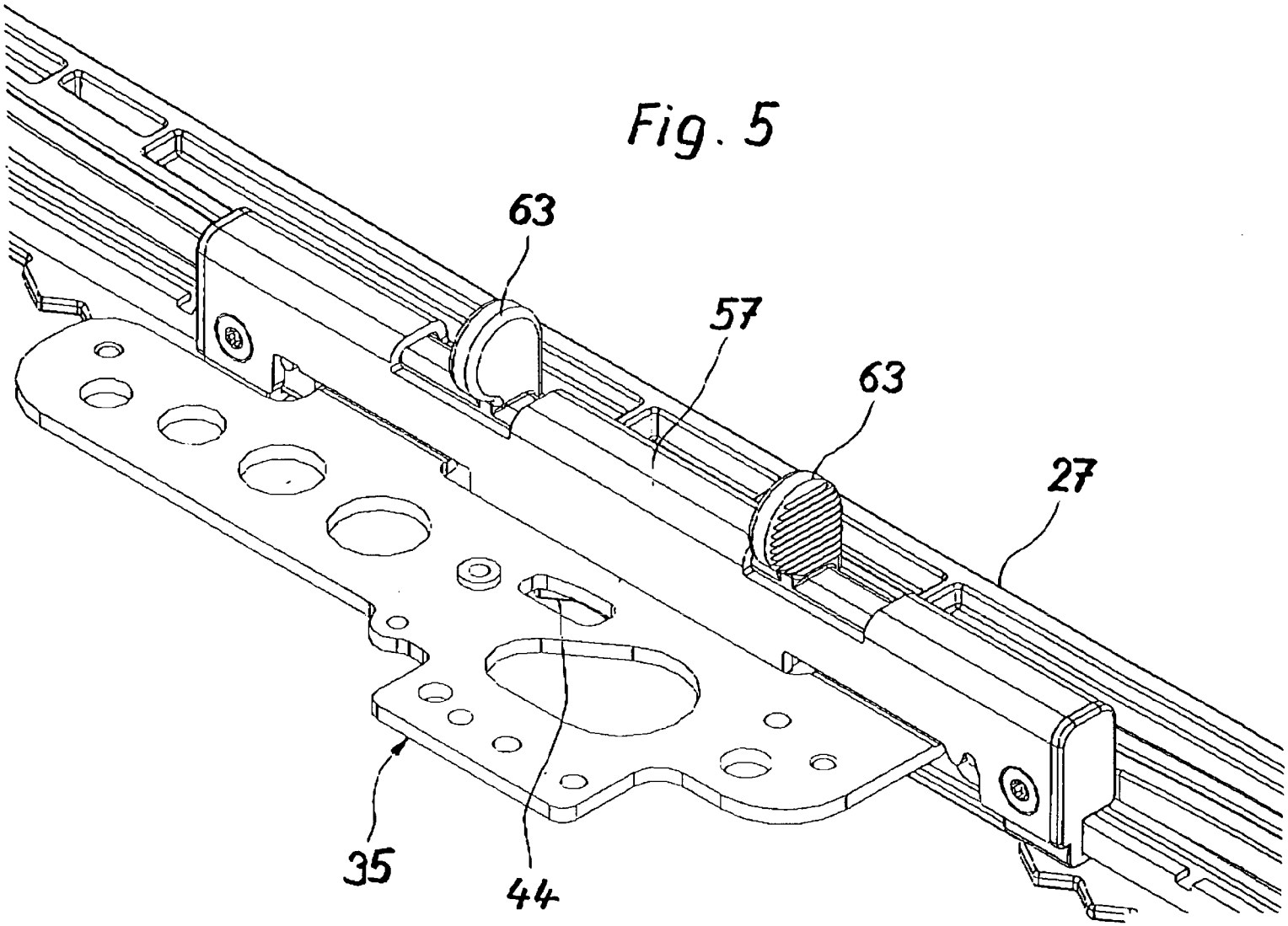
FIG. 5 is a perspective view of the latching and coupling apparatus with casing upon releasing the latching on position "44."

In FIGS. 3 and 4, the embroidery frame holding plate 35 is visible in the foreground, from which only the two plates 37 with the hooks 39 extending therefrom project beyond the housing of the embroidery frame support 25 (the latter omitted in FIG. 3). In the background, a short segment of the embroidery frame 27 with the guide and coding rail 41 attached thereupon are visible. On guide rail 41, for example, there are three coding segments 43, 44, 45, the latter being partially visible and partly covered by the embroidery frame holding plate 35. The coding segments 43, 44, 45 can be made of pronged edges. It is also possible to configure these as a bar code (not shown). On the guide rail 41, for example, a retaining and latching element, in short called retaining element 49 which forms the fastening device, is mounted movable longitudinally in a guide groove 47. The retaining element 49 can be fixed and locked in on latching and retaining slots 51 in the region of coding segments 43 to 45 on the guide rail 41. The retaining element 49, which is represented with cover 57 broken away in FIGS. 3 and 4, includes a supporting body 53 which partially encloses the guide rail 41, or extends below on its two ends. The two ends of the supporting body 53 are advantageously configured as end plates 55, which close the cover 57 on the end faces. Between the two end plates 55, in the middle, a longitudinal guide 59 is constructed for two sliding interlocks 61 mounted movably there. On the sliding interlocks 61, two upwardly projecting grip plates 63 are provided, which project upwardly beyond the covering 57. The sliding interlocks 61 include outwardly directed wedges 65 which engage oblique surfaces 67 on the retaining element 49 that are arranged basically parallel to the first wedge surface. The second wedge surfaces of the wedges 65 lie on the plates 37, and in this way brace the embroidery frame 27 free of play on the embroidery frame support 25. Furthermore, the sliding interlocks 61 include an outwardly directed latching hook 68 with an upward-lying oriented surface, which latching hooks 68 extend on the underside of the corresponding hooks 39 on the plates 37 in arrangement.

Between the two sliding interlocks 61, two helical springs 69 are held in a pre-loaded condition. The outside ends of the springs 69 are held by pegs 71 formed on the sliding interlocks. The spring ends lying opposite one another lie on a spring housing 73 which accommodates a locating spring 75 which lies on a plane perpendicular to the axes of the helical springs 69 and perpendicular to the embroidery frame holding plate 35. The locating spring 75 is braced above on the spring housing 73 and is held by a lug 77 on a one arm stop lever 79. The stop lever 79 is pivoted with its one end on the retaining element 49. The free end is configured as a downwardly directed hook 81. Its geometrical shape is constructed such that the hook 81 can engage basically free of play in one of the retaining slots 51 on the guide rail 41. The two helical springs 69 can moreover be braced in shell-like supports 83 on the upper side of the longitudinal guide 59. The longitudinal guide 59 moreover takes over the lateral guide of the stop lever 79 and also supports the pivot bolt 85. On one of the two sliding interlocks 61, a lifting component is mounted in the form of a contact surface 70 which, when the sliding interlocks 61 are pressed together with the holding plate 63 reaches underneath the free end of the stop lever 79 and lifts the locating hook 81 out of slot 51.

In FIG. 4, on the left side of the image, a portion of the cover 57 with one of the fastening screws 87 is represented. Furthermore, on the cover 57, a downwardly open recess 89 is visible into which a guide cam 91 on the plate 37 of the embroidery frame holding plate 35 engages, and establishes its height position with respect to the retaining element 49.

The function of latching and sliding the embroidery frame 27 will be explained below. An embroidery frame 27 with one, two, three or more embroidery surface sections and correspondingly many retaining slots 51 and coding sections 43 to 45 is pushed, after pressing together the two grip plates 63, vertically from above on the two plates 37 on the embroidery frame holding plate 35 until the two guide cams 91 are completely inserted into the recesses 89. Now the pressure exerted on the holding plates 63 by the fingers of the one hand can be diminished to the extent that on the one hand, the hook 81 of the lever 79 is sprung against the surface of the guide rail 41. On the other, however, the wedges 65 do not yet lie snugly on the inclined surfaces 67, and consequently a movement of the embroidery frame 17 in the guide groove 47 is possible. When the holding plates 63 are further released, the latching hooks 68 slide under the matching hooks 39 on plates 37. In this way, the embroidery frame 27 is held vertically on the support 25.

As soon as, with lateral sliding, the hook 81 reaches the region of a slot 51 on the guide rail 41, the lever 79 pivots downwardly due to the force of the locating spring 75 and latches the embroidery frame 27 on the embroidery frame support 25, for example, in the region of code section 44 (FIGS. 3/4). When no forces are operating on the grip plates 63 any more, the two helical springs 69 press the wedges 65 on the inclined surfaces 67. Through the play of the retaining element 59 in the guide groove 47, the supporting body 59 is pressed onto the two plates 37. There is now present in the x and y direction a completely play-free connection between embroidery frame 27 and support 25. Due to the engagement of the hook 81 in the slot 51 on coding site 44, the coding resources, here prongs, come before a sensor element (not represented) on the support 25 which first of all, on the basis of the prongs, recognizes the size and construction of the embroidery frame 27 and moreover also the site at which the embroidery frame 27 is joined with the support 25. The data gathered from the coding by the sensor element is communicated to the machine control unit. Subsequently, the embroidering of the of the embroidering field within embroidery frame 27 allocated to code segment 44 can take place. In order also to be able to process the adjacent embroidery field, the grip plates 63 are pressed together with two fingers of one hand until the hook 81 and the wedge 65 have left the snug arrangement and a lateral sliding of the embroidery frame 27 on the embroidery frame support 25 is possible. As soon as the hook 81 is latched on the adjacent slot 51, the not represented sensor unit, on the basis of the structure of coding section 43, ascertains the new position of the embroidery frame 27 and signals the control unit of the sewing machine 1. This can now forward the stored sewing or embroidery pattern in the new embroidering field at the proper site.

What is claimed is:

1. Device for detachable fastening of an embroidery frame (27) on an embroidery frame support (25) of an embroidery module (23) in a program-controlled sewing or embroidering machine (1), comprising a drive installed in the embroidery frame support (25) with an embroidery frame holding plate (35) attached thereupon, a retaining and latching element (49) installed on the embroidery frame (27) with two movable sliding interlocks (61) that are spring-loaded and include two grip plates (63), the sliding interlocks (61) each engage with one latching hook (68) on correspondingly constructed latching surfaces in recesses (70) on plates (37) located on the embroidery frame holding plate, the retaining and latching element (49) is mounted for movement along a guide rail 41 on the embroidery frame (27), and code sections (43, 44, 45) and latching slots (51) are positioned on at least one of the guide rail (41) or the embroidery frame (27).

2. The device according to claim 1, wherein positioning and clamping wedges (65) are positioned on the retaining and latching element (49), which hold the embroidery frame (27) in a fixed position on the embroidery frame support (25) free of play relative in x and y directions.

3. The device according to claim 1, wherein a latching apparatus is installed between the two sliding interlocks (61), with which the embroidery frame (27) is latchable free of play against lateral motion on the embroidery frame support (25).

4. The device according to claim 3, wherein the latching apparatus includes a vertically movable, spring-loaded latching hook (81), which is movable through pressing the grip plates (63) together from a latching position into a sliding position and is guidable through a locating spring (75) into the latching position again.

5. The device according to claim 4, wherein the latching apparatus is constructed as a lever (79) pivotable about a generally horizontal axis and includes the latching hook (81) on one end thereof.

6. The device according to claim 4, wherein the latching apparatus can be engaged in a latching slot (51) on the guide rail (41) through the locating spring (75) located in a spring housing (73).

7. The device according to claim 1, wherein positioning and clamping elements (65) are constructed on outwardly directed ends of the sliding interlocks (61), and include a first wedge surface that engage respective inclined surfaces (67) on the retaining and latching element (49), and a second wedge surface that engage the plates (37).

8. The device according to claim 5, wherein a contact surface (70) that functions as a lifting component is constructed on one of the sliding interlocks (61), to guide the hook (81) on the lever (79) out of a latching slot (51) when the two sliding interlocks (61) are brought together.

9. The device according to claim 1, wherein the code sections (43, 44, 45) contain information on at least one of a size and shape of the embroidery frame (27) and a geometrical or physical position on the embroidery frame (27).

* * * * *